United States Patent [19]

Skrypek et al.

[11] 4,140,053

[45] Feb. 20, 1979

[54] MANDREL MOUNTING AND TRIP MECHANISM FOR CONTINUOUS MOTION DECORATOR

[75] Inventors: John P. Skrypek, Mahwah; Robert Williams, Randolph; Arnold Peters, West Paterson; Russell Di Donato, Maplewood, all of N.J.

[73] Assignee: Sun Chemical Corporation, New York, N.Y.

[21] Appl. No.: 807,260

[22] Filed: Jun. 16, 1977

[51] Int. Cl.[2] ..... B41F 17/22

[52] U.S. Cl. ..... 101/40; 101/247

[58] Field of Search ..... 101/38 R, 38 A, 39, 101/40, 247

[56] References Cited

U.S. PATENT DOCUMENTS

| | | | |
|---|---|---|---|
| 3,356,019 | 12/1967 | Zurick | 101/39 |
| 3,851,579 | 12/1974 | Zurick | 101/39 |
| 4,037,530 | 7/1977 | Sirvet | 101/40 |

*Primary Examiner*—Clifford D. Crowder
*Attorney, Agent, or Firm*—Cynthia Berlow

[57] ABSTRACT

A continuous motion decorator is provided with mandrels pivotally mounted to a carrier wheel and radially positioned by a stationary cam. An individual eccentric, operated by an individual power cylinder, is interposed between each mandrel pivot. When an unloaded or misloaded mandrel is detected, the associated eccentric is operated to retract mandrel from the printing blanket. Each mandrel is part of a subassembly including a pair of crank arms that are integrally connected by a section parallel to the axis for the carrier wheel. The mandrel is mounted on one crank arm and cam follower means is mounted on the other crank.

19 Claims, 16 Drawing Figures

MANDREL MOUNTING AND TRIP MECHANISM FOR CONTINUOUS MOTION DECORATOR

U.S. Pat. No. 3,766,851 issued Oct. 23, 1973 to E. Sirvet et al for Continuous Can Printer and Handling Apparatus describes high speed apparatus for applying decorations to the exterior of cylindrical containers while they are mounted on mandrels disposed along the periphery of a large continuously rotating wheel-like carrier. In apparatus of this type means are provided to assure that when a mandrel moves through the decorating zone along a normal path for printing, such mandrel is properly loaded with a cylindrical container. If a particular mandrel is empty or improperly loaded, means are provided to assure that this mandrel does not engage the printing blanket. In the device of the aforesaid U.S. Pat. No. 3,766,851 not only is an unloaded or improperly loaded mandrel moved to a no-print position but one or more adjacent mandrels may not be in proper printing positions as they move through the printing zone so that containers thereon, even though properly loaded, are not decorated properly.

Other prior art approaches for preventing engagement between the printing blanket and an unloaded or improperly loaded mandrel are to segmentize either the printing blanket or mandrel controlling cam. This cam is required since the print blanket and mandrel carrier are rotating continuously so that the mandrel must track the print blanket during printing. By controlling positions of selected segments the normal or print position of an unloaded or improperly loaded mandrel relative to the printing blanket is changed to a relative tripped or no-print position when this unloaded or improperly loaded mandrel moves through the printing zone. However, these last two arrangements have also resulted in misprinting or non-printing of properly loaded containers and have resulted in more complicated constructions for the printing blanket or mandrel control cam as the case may be.

Pursuant to the instant invention the difficulties encounted by the prior art in establishing no-print positions for the mandrel are overcome by providing an integrally formed member having two crank arms, one of which mounts a mandrel and the other of which mounts a follower for the cam means which radially positions the mandrels. This integral member is pivotally mounted to the carrier wheel and an eccentric means is interposed between the carrier and pivot axis for the integral member. A double acting power cylinder operates the eccentric to one of two positions depending upon whether the mandrel is properly loaded or is misloaded. When the mandrel is properly loaded the position of the eccentric means is such that the pivot axis for the integral member is positioned so that the mandrel is in its normal printing position as it moves through the printing zone. However, when the mandrel is misloaded the power cylinder is actuated to operate the eccentric to its other position thereby moving the pivot axis so that as the mandrel moves through the printing zone it is in a no-print position.

Since the response time for the power cylinder and its speed of action are so quick, since the inertia forces that must be overcome to move the relatively lightweight integral member and elements mounted thereto a very short distance are very small, and since only a short angular motion of the mandrel carrier wheel takes place as the misloaded mandrel is moved between the normal and no-print positions, the carrier wheel may rotate at a very high speed. Further, since only the misloaded mandrel is moved to the no-print position, all properly loaded containers will be properly printed.

Accordingly, a primary object of the instant invention is to provide an improved construction for a high speed continuous motion decorator for cylindrical containers.

Another object is to provide high speed apparatus of this type having improved means for establishing a no-print condition when a mandrel is unloaded or improperly loaded.

Still another object is to provide apparatus of this type having reduced maintenance requirements.

A still further object is to provide apparatus of this type which is of simplified construction.

These objects as well as other objects of this invention shall become readily apparent after reading the following description of the accompanying drawings in which:

FIG. 1A is a timing diagram for apparatus of the type illustrated in FIG. 1.

Figures 5, 6, 7, 8:
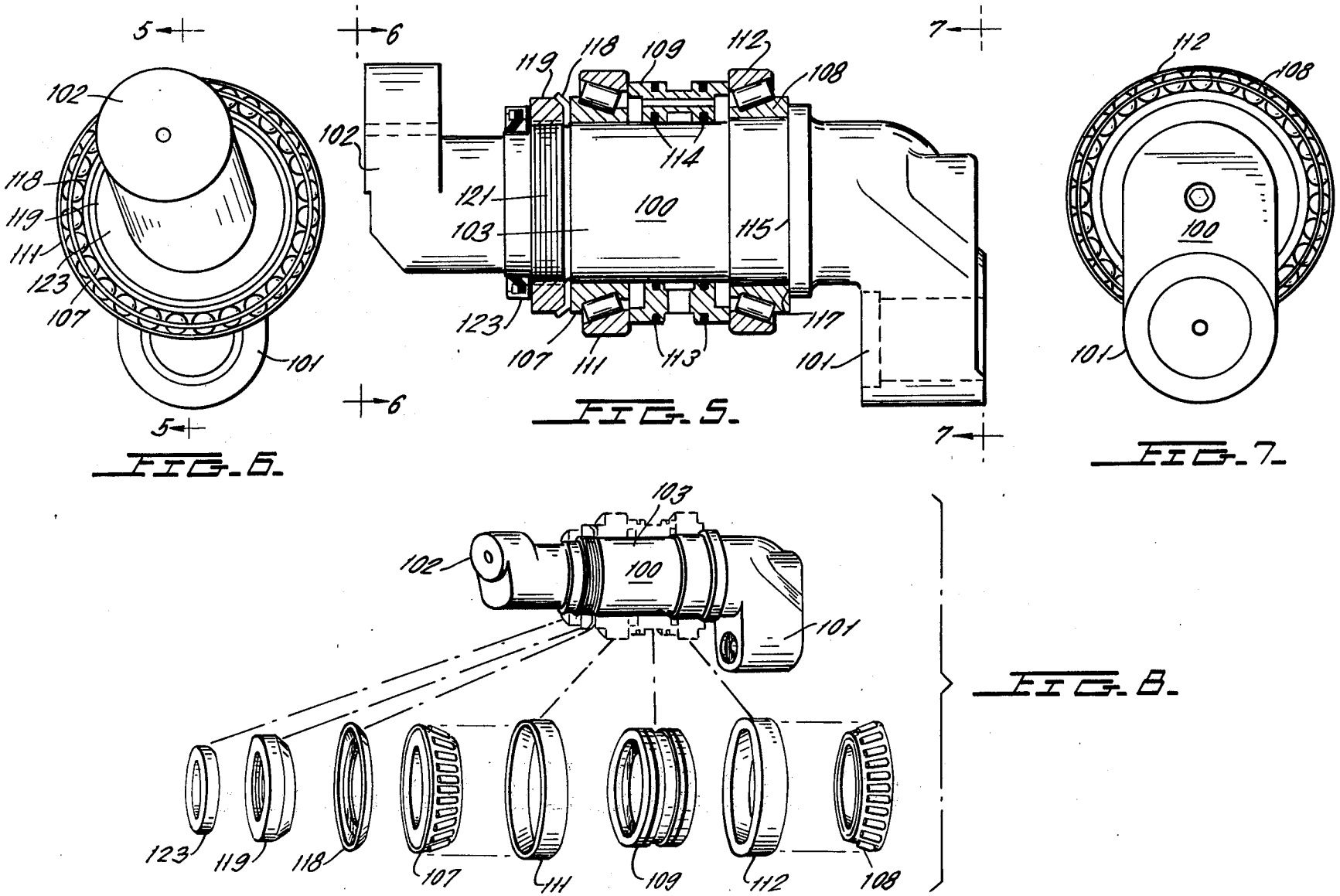
FIG. 5 is a side elevation of the integral member, which provides the cranks to which the mandrel and cam followers are mounted, and elements mounted thereto sectioned along line 5—5 of FIG. 6 looking in the direction of arrows 5—5.

FIGS. 6 and 7 are end views looking in the directions of the respective arrows 6—6 and 7—7 in FIG. 5.

FIG. 8 is an exploded perspective showing the elements which mount the integral member of FIG. 5 to the carrier wheel.

Figure 2:
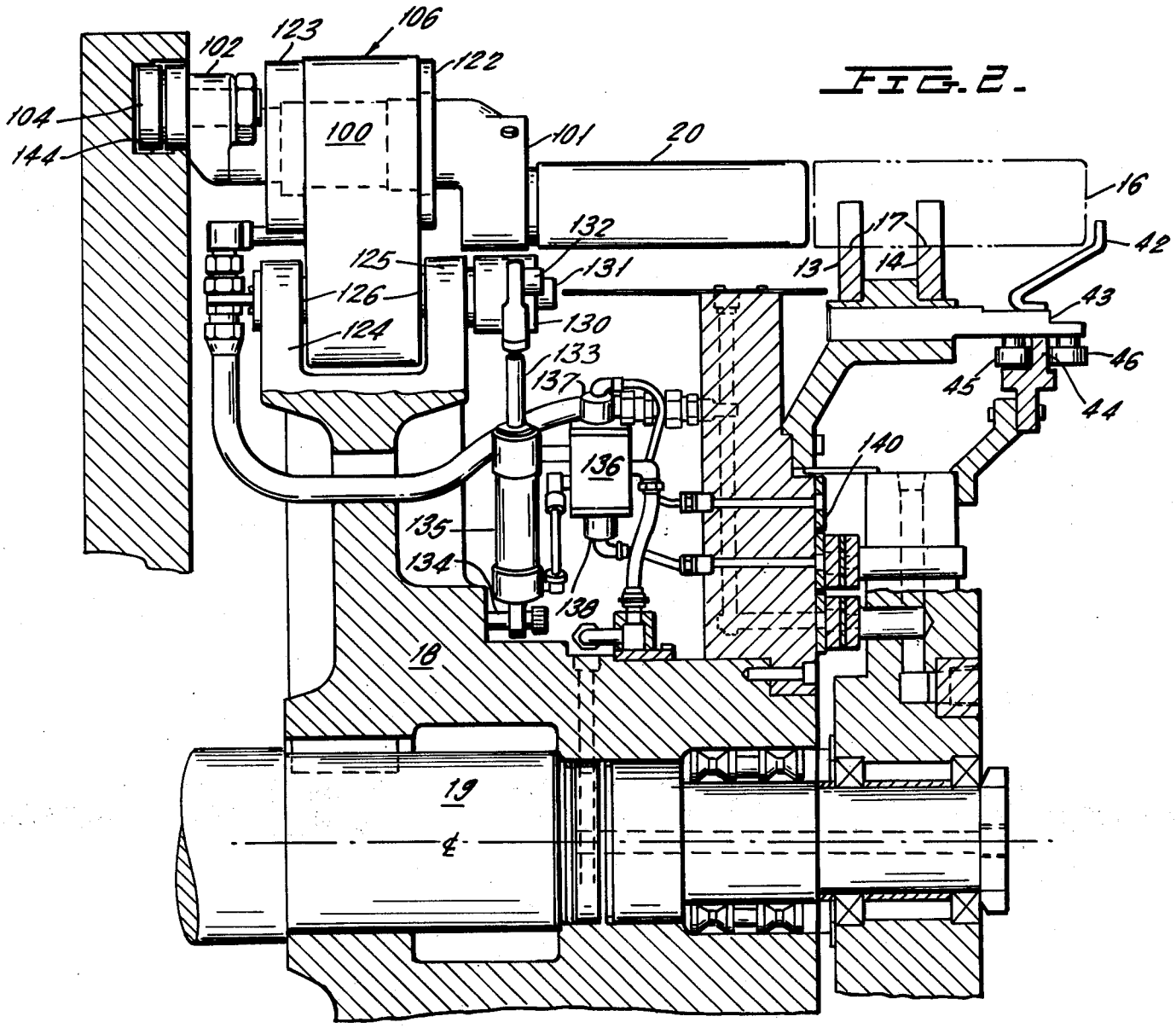
FIG. 2 is a fragmentary cross-section of the mandrel carrier and loading wheel taken through line 2—2 of FIG. 1 looking in the direction of arrows 2—2.
Figure 3:
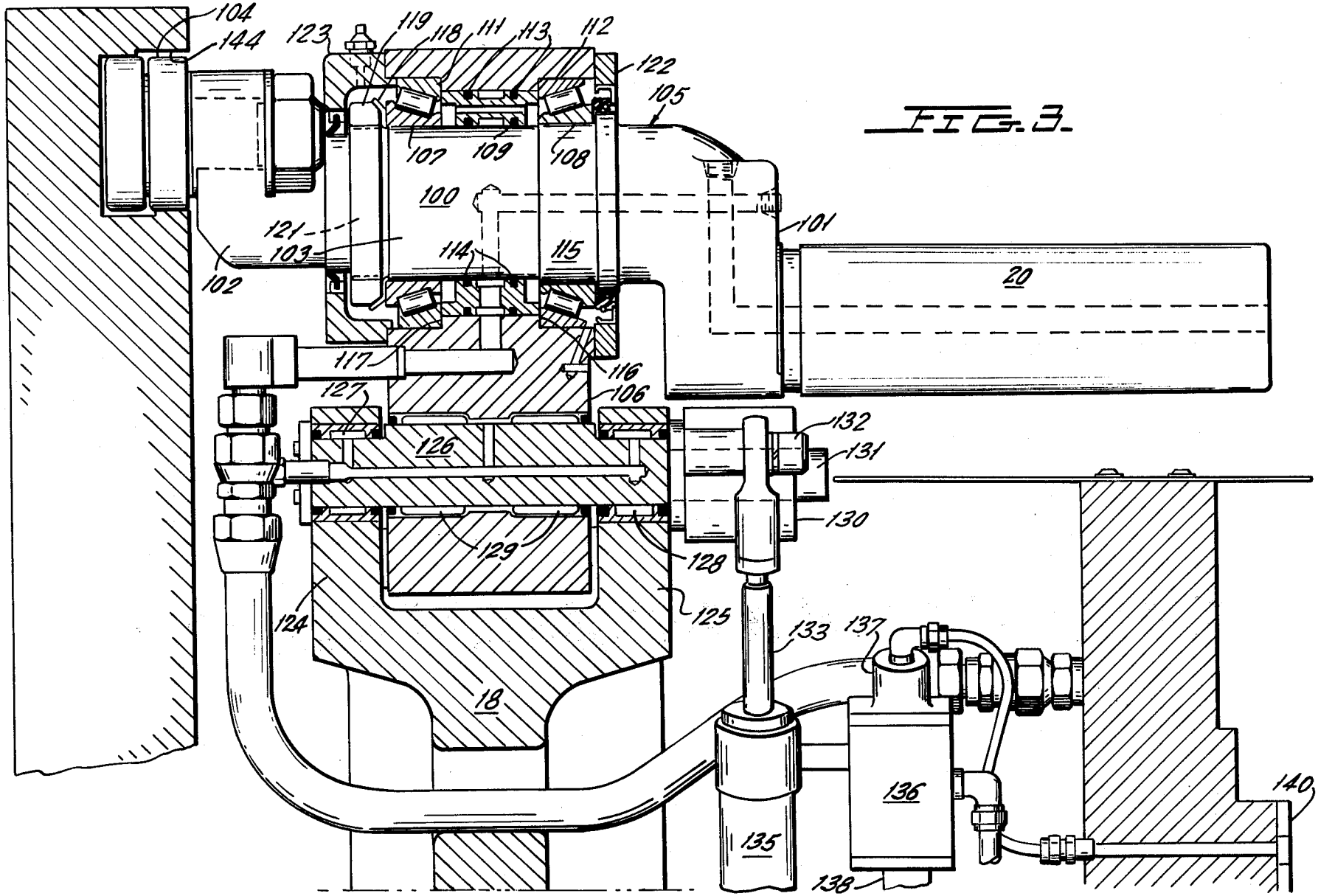
FIG. 3 is a fragmentary cross-section showing the mounting of a mandrel-follower subassembly to the carrier wheel.
Figure 4:
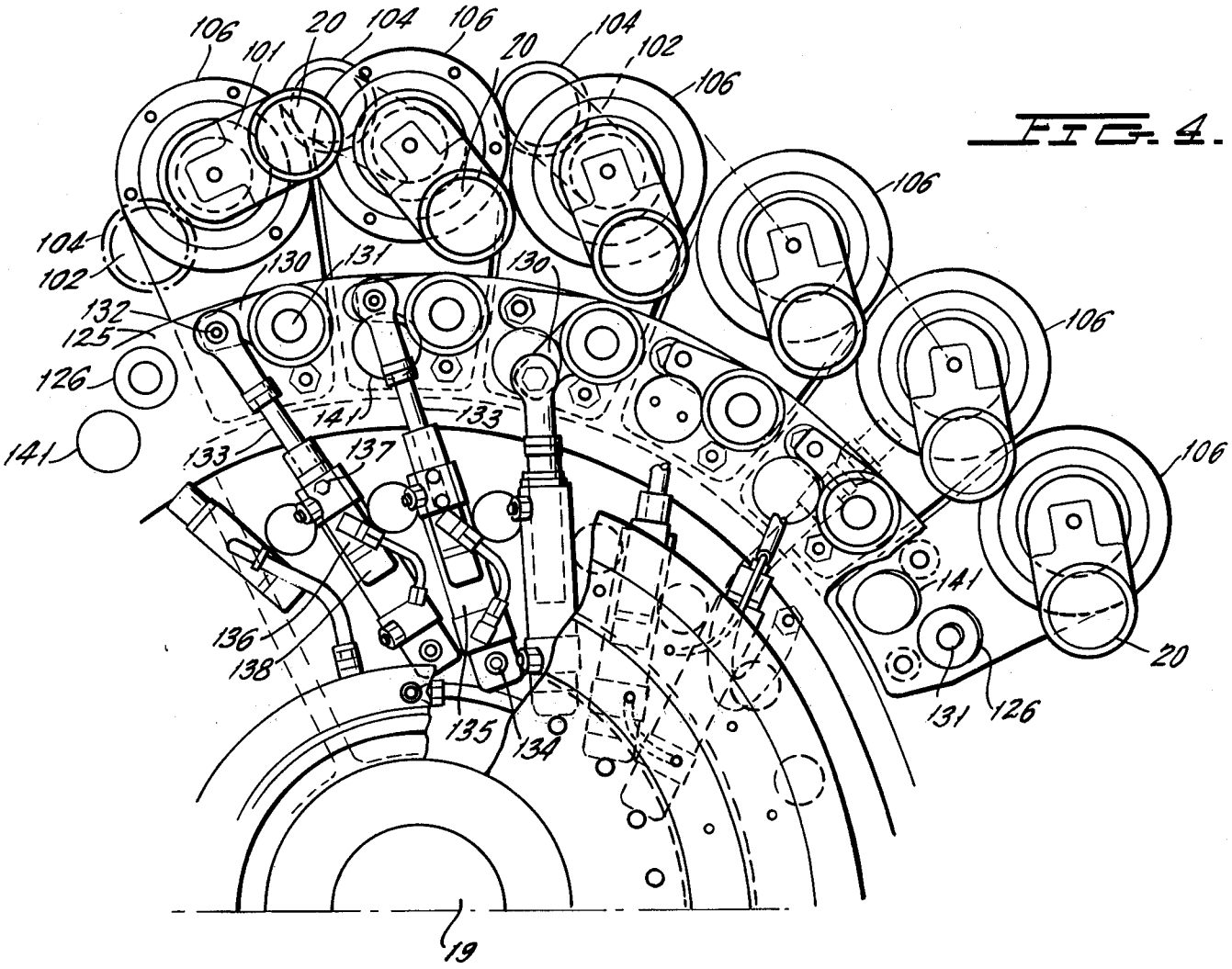
FIG. 4 is a partial front elevation of the mandrel carrier wheel.
Figure 9:
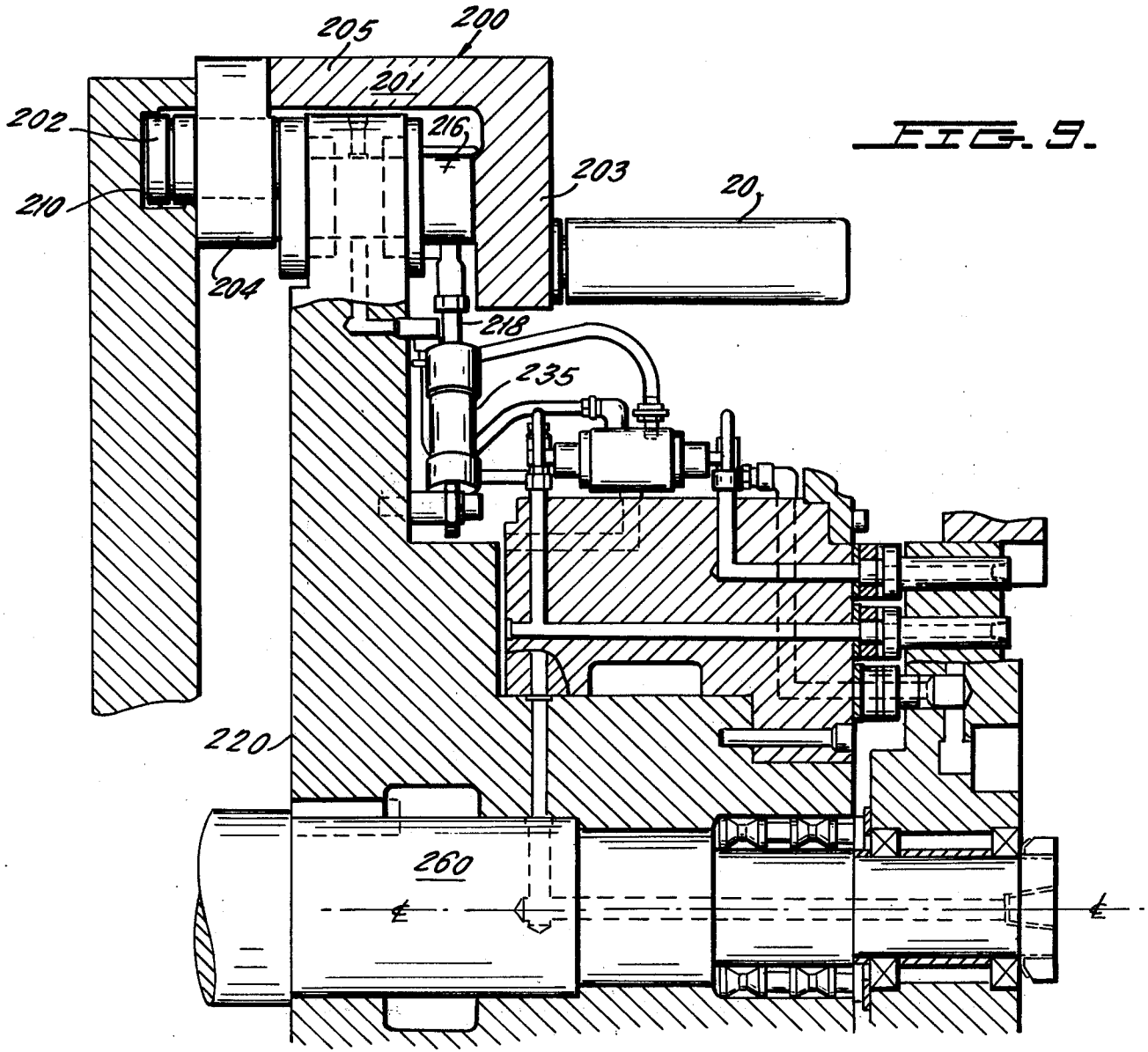

FIG. 9 is a fragmentary cross-section similar to FIG. 2, illustrating another embodiment of the instant invention.

Figure 10:
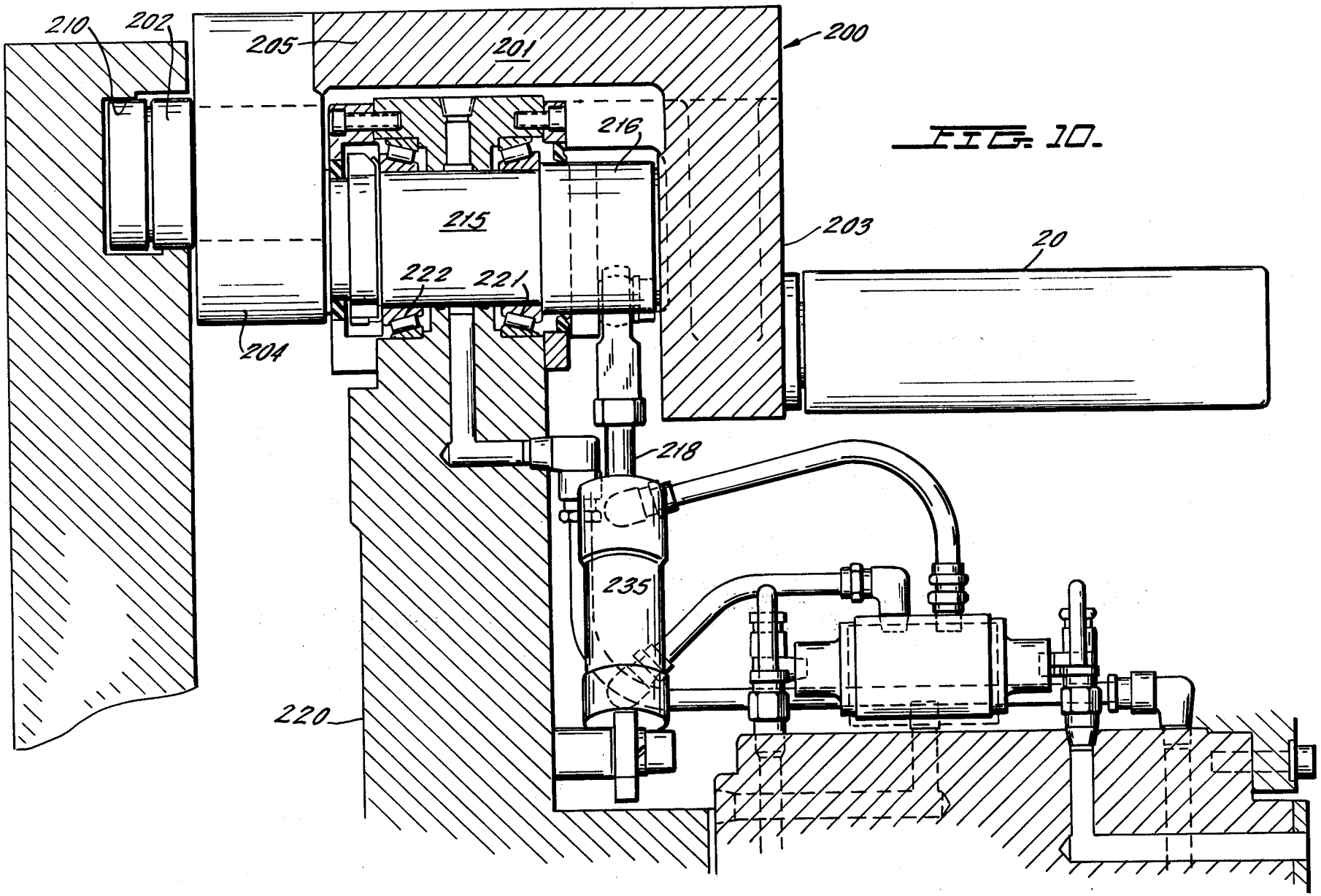

FIG. 10 is an enlarged portion of FIG. 9.

Figures 11, 12, 13, 14:
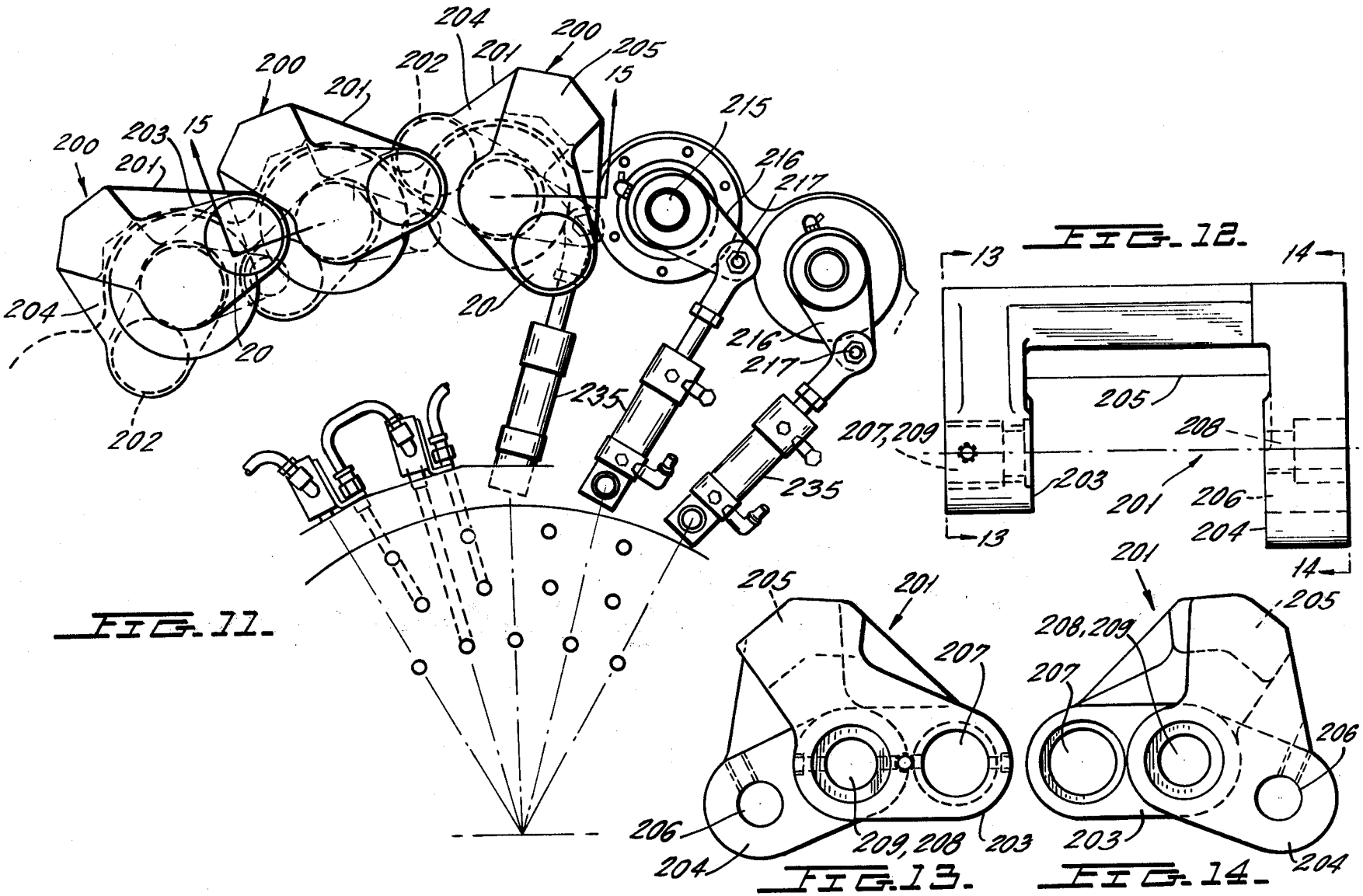

FIG. 11 is a partial front elevation of the carrier wheel for the embodiment of FIG. 9.

FIG. 12 is a side elevation of the integral member which provides the cranks to which the mandrel and followers are mounted in the embodiment of FIG. 9.

FIGS. 13 and 14 are additional elevations of the integral member illustrated in FIG. 12 looking in the directions of the respective arrows 13—13 and 14—14 of FIG. 12.

Figure 15:
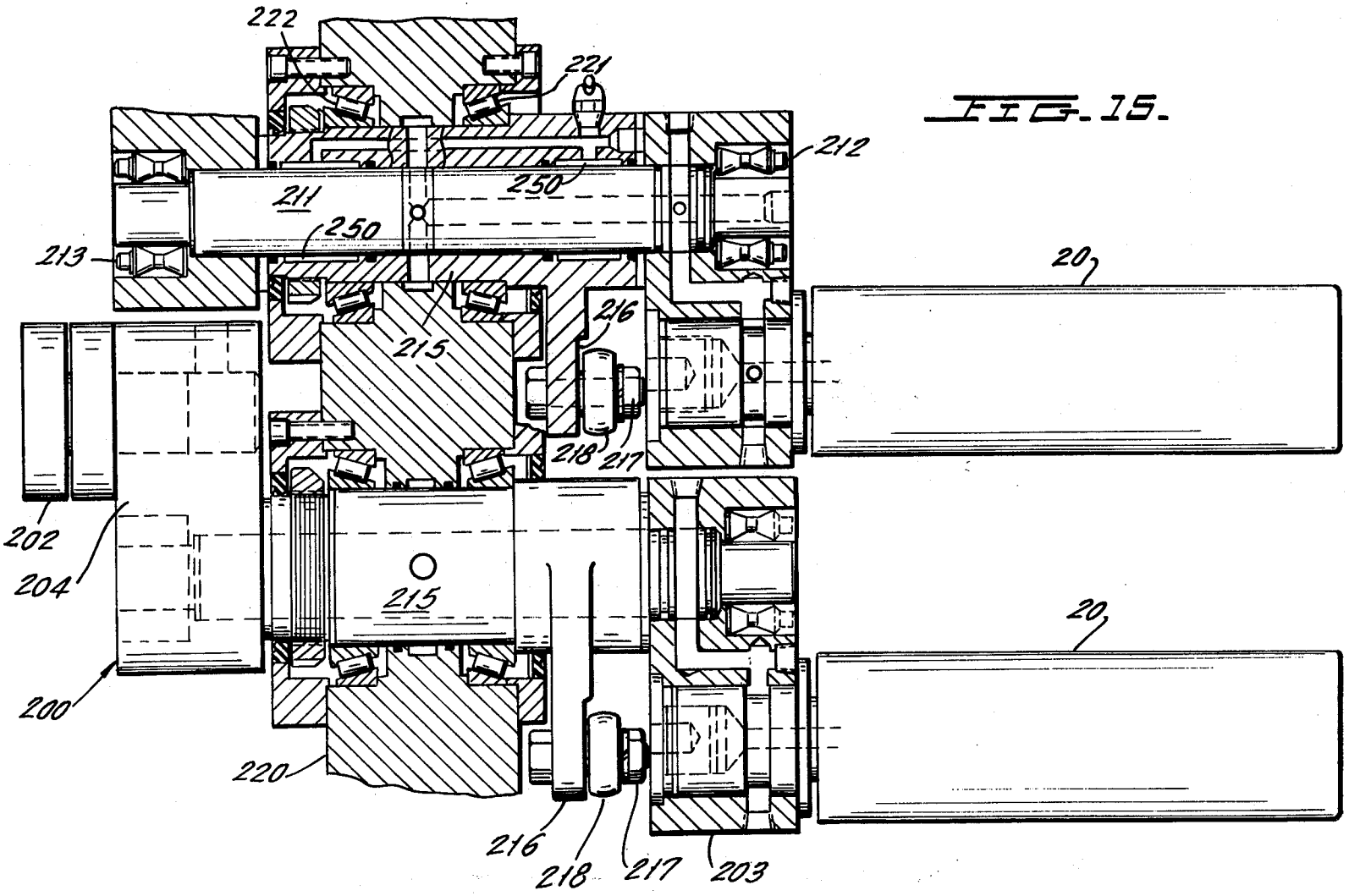

FIG. 15 is a partial cross-section taken through line 15—15 of FIG. 11.

Figure 1:
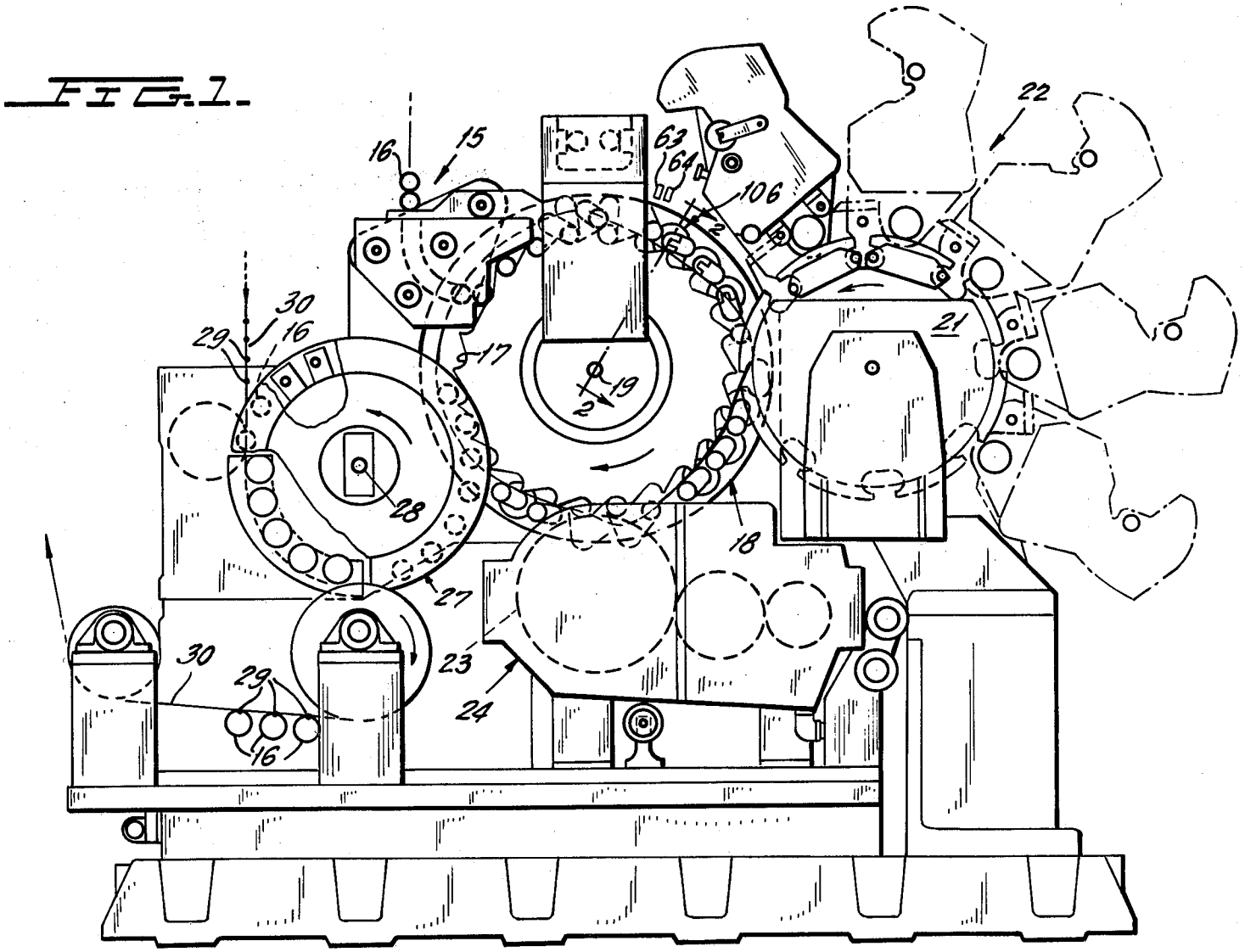
FIG. 1 is a front elevation of continuous motion decorating apparatus constructed in accordance with teachings of the instant invention.
Figure 7A:
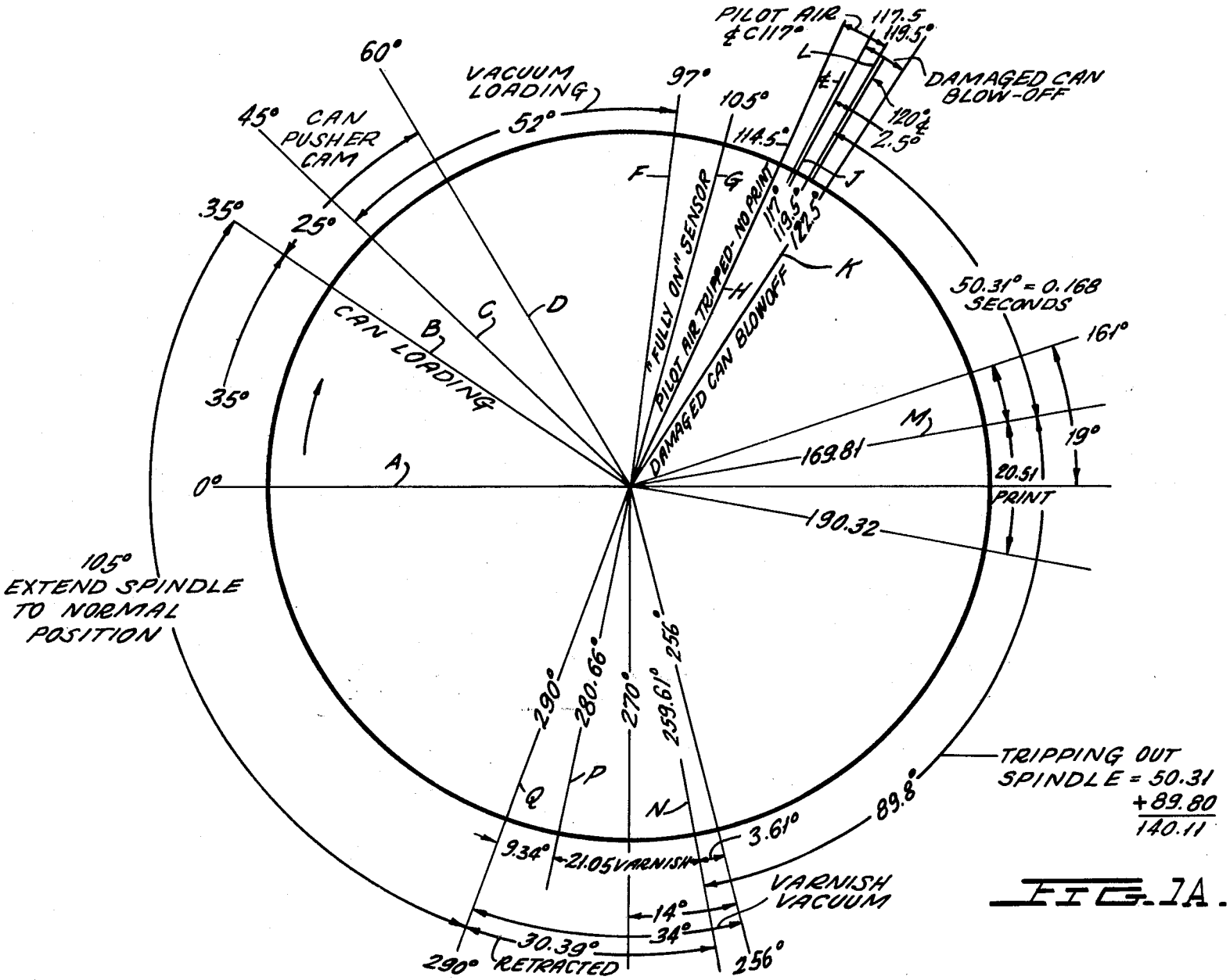

Now referring to the Figures and more particularly to FIGS. 1 through 8. The continuous motion cylindrical container decorating apparatus of FIG. 1 is of the general type described in the aforesaid U.S. Pat. No. 3,766,851. Briefly, the apparatus of FIG. 1 includes infeed conveyor chute 15 which receives undecorated cans 16, open at one end thereof, from a supply (not shown) and places them in arcuate cradles or pockets 17 along the periphery of spaced rings 13, 14 (FIG. 2). The latter are fixedly secured to carrier wheel 18 which in turn is keyed to horizontal drive shaft 19. Horizontal spindles or mandrels 20 are also mounted to wheel 18, with each spindle 20 being in spaced horizontal alignment with an individual pocket 17 in a short region extending downstream from infeed conveyor 15. Undecorated cans 16 are transferred from each cradle 17 to a mandrel 20 by an individual spring arm 42 mounted on slide 43 which is driven horizontally through the action of stationary cam 44 and followers 45, 46 secured to slide 43. Suction applied through an axial passage extending to the end of mandrel which receives container 16 draws the latter to final seating position on mandrel 20.

While mounted to mandrels 20, cans 16 are decorated by being brought into engagement with continuously rotating image transfer mat or blanket 21 of the multicolor printing press indicated generally by reference numeral 22. Thereafter, and while still mounted to mandrels 20, each decorated can 16 has a protective film of varnish applied thereto by engagement with the periphery of applicator roll 23 in the overvarnish unit indicated generally by reference numeral 24. Cans 16 with decorations and protective coating thereon are then transferred from mandrels 20 to suction cups (not shown) mounted along the periphery of transfer wheel 27. The latter rotates continuously about shaft 28 in the center. Can 16 carried by transfer wheel 27 are deposited on generally horizontal pins 29 carried by chain-type output conveyor 30 which carries cans 16 through a curing oven (not shown).

Each mandrel 20 is loaded with a can 16 by the time mandrel 20 is in the proximity of sensors 63, 64 which detect whether the particular mandrel 20 contains a properly mounted can 16. If sensors 63, 64 detect that a mandrel 20 is unloaded or is not properly loaded, then as this mandrel 20 passes through the decorating zone wherein printing blanket 21 normally engages cans 16 on mandrels 20, as will hereinafter be explained, this misloaded mandrel 20 is moved to a "no-print" position wherein as this mandrel 20 moves through the decorating zone it will be spaced from the periphery of blanket 21.

More particularly, each mandrel 20 projects at right angles from crank arm 101 being freely rotatable thereon near the free end thereof. Arm 101 is part of an integral member 100 which also includes another crank arm 102 and horizontal connecting section 103 having a circular cross-section. Arms 101, 102 are disposed in generally parallel planes transverse to connecting portion 103, are positioned at opposite ends of portion 103, and extend in opposite directions therefrom. Double roller cam follower 104 is freely mounted to arm 102 near its free end on a horizontal axis. The combination of integral member 100, mandrel 20 and cam follower 104 constitutes follower-mandrel asembly 105.

Each assembly 105 is pivotally mounted to a wedge shaped block-like support 106 with connection section 103 extending transversely through an aperture in support 106, and being supported on the inner races of tapered bearings 107, 108. Cylindrical pressure-vacuum distribution sleeve 109, to which outer sealing rings 113, 113 and inner sealing rings 114, 114 are mounted, is disposed between bearings 107, 108. Integral member 100 is mounted to support 106 by placing outer race 112 of bearing 108 against support member shoulder 116 and mounting the inner race of bearing 108 against shoulder 115 of member 100. Crank arm 102 is then passed from right to left with respect to FIG. 3 through the horizontal passage in support block 106 until bearing 108 seats on outer race 112. Thereafter, sleeve 109 is moved over crank arm 102 to a position abutting the inner race of bearing 108 and race 112. Outer race 111 of bearing 107 is then positioned against support shoulder 117 and bearing 107 is seated on outer race 111. Washer 118 is mounted adjacent to the left side of bearing 107, nut 119 is mounted on the threaded portion 121 of connecting section 103, and sealing ring assemblies 122, 123 are mounted adjacent bearing 108 and nut 119, respectively. Thereafter, mandrel 20 and follower 104 are mounted to member 100.

The radially inward portion of support block 106 is disposed between arms or lips 124, 125 which constitute the forked or bifurcated periphery of carrier wheel 18. Shaft 126 extends through aligned apertures in arms 124, 125 as well as through a horizontal aperture in support block 106 to pivotally mount the latter to carrier 18. It is noted that the portions of shaft 126 which pivot in bearings 127, 128 in arms 124, 125 are eccentric with respect to the portion of shaft 126 which engages bearings 129, 129 supported in block 106.

The end 131 of shaft 126 which extends outboard of arm 125 is locked against rotation to one end of crank 130 whose other end is pivotally connected by pin 132 to the free end of extendable arm 133 for double acting power cylinder 135. The end of cylinder 135 remote from crank 130 is pivotally mounted to carrier 18 on pin 134 (FIG. 2).

In a manner well known to the art, operation of power cylinder 135 is controlled by spool-type pilot valve 136 having pilots 137, 138, which in turn are selectively connected to pressure and/or vacuum sources through valving provided by the relatively moving surfaces at interface 140 in accordance with signals generated by detectors 63, 64. When power cylinder arm 133 is extended support block 106 is projected more radially outward than it is when arm 133 is retracted. An individual passive or follower eccentric 141 is provided to support and guide movement of block 106 on carrier 18. Moving block 106 radially outward moves the connecting or pivot section 103 of integral member 100 outward, and since the free end of cam follower arm 102 is constrained by closed cam track or slot 144 mandrel 20 moves radially outward.

During normal operation power cylinder arms 133 are extended so that as mandrels 20 move through the decorating zone, the action of cam follower 104 in cam slot 144 causes mandrel 20 to track the periphery of printing blanket 21 and the properly loaded can 16 on mandrel 20 engages blanket 21 whereby decorations are applied to this can 16. However, when detectors 63, 64 determine that a mandrel 20 is unloaded or is misloaded, control signals are generated so that power cylinder 135 operates to retract its arm 133 and by so doing pivots shaft 126 to move support block 106 radially inward. As previously noted, this moves connecting section 103 of integral member 100 inward, thereby moving mandrel 20 radially inward so that the latter, as well as a misloaded can 16 thereon, do not engage the periphery of decorating blanket 21. Mandrel 20 remains in this radially inward tripped or no-print position until this mandrel 20 is downstream of overvarnish unit 24 after which cylinder 135 is operated to extend arm 133 thereby moving the pivot center for assembly 105 radially outward to its normal or print position.

FIG. 1A is a timing diagram for no-print apparatus constructed in accordance with the teachings of FIGS. 1 through 8. More particularly, the timing diagram of FIG. 1A is for a construction in which the distance from the center of mandrel wheel 18 to the center of mandrel 20 during printing is approximately 20 inches, there are 24 mandrels on wheel 18 and wheel 18 rotates at a speed of 50 R.P.M. Thus, the wheel 18 completes a revolution each 1.2 seconds and moves 1° each 0.00333 second, resulting in the decorating of 1200 cans per minute.

Starting from the zero axis A and moving clockwise, it is seen that loading of pocket 17 from conveyor 15 takes place at the 35° position B. During the next 25° movement to position D pusher 42 moves from right to left with respect to FIG. 2 to load can 16 on mandrel 20 in conjunction with mandrel suction applied between the 45° position C and the 97° position F. At the 105° position G sensors 63, 64 determine whether mandrel 20 is properly loaded and if it is not, at the 114.5° position H pilot valve 136 is actuated to start operation of cylinder 135 to no-print position. Such operation is completed at the 119.5° position L. Blowoff for damaged cans is applied to mandrel 20 between the 117.5° position J and the 122.5° position K. Power cylinder 135 begins to operate in its retracting or trip stroke as soon as valve 136 is actuated and by the time mandrel 20 reaches the 169.81° position M where decorating would ordinarily take place, power cylinder arm 133 is retracted through approximately ⅞" of its complete stroke of 2". This partial retraction of arm 133 combined with the action of cam 144 results in a clearance between mandrel 20 and blanket cylinder 21 of approximately 0.025" in the decorating zone extending downstream for 20.51° from the 169.81° position M. Mandrel 20 reaches the 259.61° position N where the 21.05° varnish application zone begins, mandrel 20 is retracted from varnish applicator roll 23 by approximately 0.05" from its normal position. The varnish applicating zone ends at the 280.66° position P and pilot valve 136 is actuated at the 290° position Q to extend power cylinder arm 133. There is now 105° between positions Q and B for operating power cylinder 135 through its full stroke to operate mandrel 20 from its fully retracted no-print position to its normal fully extended print position.

Now referring to FIGS. 9 through 15 which illustrate another embodiment of the instant invention in which each mandrel 20 is part of an assembly 200 which also includes integral bridge member 201 and dual cam follower 202. Integral member 201 includes crank arms 203, 204 positioned at opposite ends of connecting portion 205 extending at right angles thereto and in the same direction. Mandrel 20 is rotatably mounted at the free end of crank arm 203 on a bearing extending into aperture 207 while cam follower 202 is mounted on a bearing extending into aperture 206 at the free end of crank arm 204. Crank arms 203, 204 are provided with axially aligned horizontal aperture 209, 208, respectively, which receive tapered locking assemblies 212, 213, respectively, engaged with the ends of shaft 211 about which assembly 200 pivots as follower 202 traverses stationary cam 210.

Shaft 211 extends through eccentric sleeve 215 being pivotally supported on needle bearings 250. Sleeve 215 is provided with radial extension or crank 216 which is connected at its free end to the free end of operating rod 218 by pin means 217. Rod 218 extends from power cylinder 235 whose operation is controlled in the same manner as the previously described operation of power cylinder 135. The outer portion of eccentric 215 is pivotally supported on mandrel carrier wheel 220 by tapered bearings 221, 222. With assembly 200 mounted to carrier wheel 220, section 205 bridges the peripheral edge of wheel 220 and crank arms 203, 204 confront opposite sides of wheel 220.

It is noted that the embodiment of FIGS. 9 through 15 does not have bearing caps which must be removed for dismounting assembly 200. For dismounting of the latter it is merely necessary to remove locks 212, 213 and then withdraw shaft 211 axially.

The embodiment illustrated in FIGS. 9 through 15 operates in essentially the same manner as the embodiments of FIGS. 1 through 8. That is, as a properly loaded mandrel 20 moves through the decorating zone this mandrel 20 tracks the periphery of decorating blanket 21 under the control of cam follower 202 in engagement with cam slot 210, with assembly 200 pivoting about shaft 211 as required. As a mandrel 20 is unloaded or misloaded, this condition is detected by sensors 63, 64 which generate signals for controlling the power cylinder 235 connected to the misloaded mandrel 20. This power cylinder 235 is operated to retract arm 218 which in turn pivots eccentric sleeve 215 thereby moving pivot rod 211 closer to drive shaft 260 to which mandrel carrier 220 is mounted. Inward movement of shaft 211 assures that as the misloaded mandrel 20 moves through the printing zone this misloaded mandrel 20 will be in a tripped or no-print position wherein this mandrel 20 and any can mounted thereto will not engage blanket 21. Shaft 211 is returned to its outward normal print position after this mandrel 20 is downstream of overvarnish unit 24.

Thus, it is seen that the instant invention provides means to assure that only unloaded or improperly loaded mandrels are moved to no-print positions and that this movement takes place extremely rapidly thereby permitting the mandrel carrier wheel to rotate very fast. The rapidity of mandrel trip operation is a result of utilizing an individual power cylinder for moving each mandrel. Typically, the power cylinder in the embodiment of FIGS. 1 through 8 moves an eccentric approximately 45 degrees to obtain a radial movement of approximately 0.11 inch for the center of the follower-mandrel assembly. The utilization of an integral member for mounting both the mandrel and cam follower and the utilization of tapered bearings each contribute to reduced maintenance requirements and improved accuracy over an extended period of operation.

Although this invention has been described with respect to preferred embodiments, it should be understood that many variations and modifications will now be obvious to those skilled in the art, and it is preferred, therefore, that the scope of this invention be limited, not by the specific disclosure herein, but only by the appended claims.

What is claimed is:

1. Apparatus for decorating cylindrical articles including a carrier mounted for continuous rotation on a main acis, a plurality of subassemblies, an individual first means for each of said subassemblies including a pivot axis to which an individual one of said subassemblies is pivotally mounted; each of said subassemblies including a first crank, a second crank and an axially extending connecting portion having said cranks extending transverse thereto at opposite ends thereof, each of said first cranks having a cam follower mounted thereto and each of said second cranks having a cylindrical article receiving mandrel mounted thereto; said follower cooperating with a stationary cam to radially position an article on said mandrel for operative engagement with a decorating means when said pivot axis is in a normal radial position during a predetermined range of angular movement for said pivot axis about said main axis; an individual second means for each of said first means including an individual power operating means to move said pivot axis responsive to detecting that said mandrel is unloaded or is improperly loaded from said normal position to a trip position, wherein an article on the mandrel is disengaged from the decorating means during said predetermined range.

2. Apparatus as set forth in claim 1 in which each of the second means also includes an eccentric means interposed between one of the pivot axes and the carrier.

3. Apparatus as set forth in claim 2 in which each of the power operating means includes a power cylinder mounted on the carrier for driving the eccentric means to move the pivot axis between said normal and trip positions.

4. Apparatus as set forth in claim 3 in which for each of the subassemblies the connecting portion is formed integrally with both the first and second cranks.

5. Apparatus as set forth in claim 2 in which each of said first means includes a holder interposed between the carrier and an individual one of the subassemblies; said holders being mounted to said eccentric means for movement relative to said carrier.

6. Apparatus as set forth in claim 5 in which the periphery of the carrier is provided with a circular array of clevis sections; each of the holders being positioned between the arms of an individual one of the clevis sections and being mounted directly thereto by said eccentric means.

7. Apparatus as set forth in claim 6 in which for each of the subassemblies the connecting portion is formed integrally with both the first and second cranks.

8. Apparatus as set forth in claim 5 in which for each of the subassemblies the connecting portion is formed integrally with both the first and second cranks.

9. Apparatus as set forth in claim 2 in which for each of the subassemblies the connecting portion is formed integrally with both the first and second cranks.

10. Apparatus as set forth in claim 1 in which each of the connecting portions includes a cylindrical section having a cylindrical axis which coincides with the pivot axis for that particular subassembly.

11. Apparatus as set forth in claim 10 in which for each of the subassemblies the connecting portion is formed integrally with both the first and second cranks.

12. Apparatus as set forth in claim 1 in which the connecting portion is outboard of the periphery of the carrier and the pivot axis is laterally offset with respect to the connecting portion.

13. Apparatus as set forth in claim 12 in which the pivot axis extends through the carrier and between the cranks, said pivot axis being inboard of the connecting portion.

14. Apparatus as set forth in claim 13 in which the second means includes an eccentric means extending between said cranks and interposed between one of the pivot axes and the carrier.

15. Apparatus as set forth in claim 14 in which for each of the subassemblies the connecting portion is formed integrally with both the first and second cranks.

16. Apparatus as set forth in claim 13 in which for each of the subassemblies the connecting portion is formed integrally with both the first and second cranks.

17. Apparatus as set forth in claim 12 in which for each of the subassemblies the connecting portion is formed integrally with both the first and second cranks.

18. Apparatus as set forth in claim 1 in which for each of the subassemblies the connecting portion is formed integrally with both the first and second cranks.

19. Apparatus for decorating cylindrical articles including a carrier mounted for continuous rotation on a main axis, a plurality of subassemblies, an individual first means for each of said subassemblies including a pivot axis to which an individual one of said subassemblies is pivotally mounted; each of said subassemblies including a first crank, a second crank and an axially extending connecting portion having said cranks extending transverse thereto at opposite ends thereof, each of said first cranks having a cam follower mounted thereto and each of said second cranks having a cylindrical article receiving mandrel mounted thereto; said follower cooperating with a stationary cam to radially position an article on said mandrel for operative engagement with a decorating means when said pivot axis is in a normal radial position during a predetermined range of angular movement for said pivot axis about said main axis; an individual second means for each of said first means to move said pivot axis responsive to detecting that said mandrel is unloaded or is improperly loaded from said normal position to a trip position, wherein an article on the mandrel is disengaged from the decorating means during said predetermined range; said cranks and said connecting portion being integrally formed; each of said second means includes an eccentric means interposed between one of the pivot axes and the carrier; each of said second means includes a power cylinder mounted on the carrier for driving the eccentric means to move the pivot axis between said normal and trip positions.

* * * * *